US006168670B1

(12) United States Patent
Möbius et al.

(10) Patent No.: US 6,168,670 B1
(45) Date of Patent: Jan. 2, 2001

(54) METHOD OF PICKLING ARTICLES OF COPPER AND METALS LESS NOBLE THAN COPPER

(75) Inventors: Andreas Möbius, Neuss; Wolfgang Thiele, Eilenburg, both of (DE)

(73) Assignee: LPW-Blasberg Anlagen GmbH, Neuss (DE)

( * ) Notice: Under 35 U.S.C. 154(b), the term of this patent shall be extended for 0 days.

(21) Appl. No.: 09/156,530

(22) Filed: Sep. 17, 1998

(30) Foreign Application Priority Data

Dec. 30, 1997 (DE) ..... 197 58 072

(51) Int. Cl.[7] ..... C23G 1/00; C25B 1/28

(52) U.S. Cl. ..... 134/2; 134/3; 134/10; 134/41; 205/471; 205/583

(58) Field of Search ..... 134/2, 3, 10, 41; 205/471, 583, 584, 586

(56) References Cited

U.S. PATENT DOCUMENTS

| | | | | |
|---|---|---|---|---|
| 3,915,816 | * | 10/1975 | Rossberger | 205/471 |
| 4,144,144 | * | 3/1979 | Radimer et al. | 204/82 |
| 4,578,162 | * | 3/1986 | McIntyre et al. | 205/583 |
| 5,445,717 | * | 8/1995 | Karki et al. | 205/471 |

* cited by examiner

*Primary Examiner*—Randy Gulakowski
*Assistant Examiner*—Saeed T. Chaudhry
(74) *Attorney, Agent, or Firm*—Herbert Dubno; Jonathan Myers

(57) ABSTRACT

Articles of copper and brass can be uniformly pickled in a solution utilizing peroxosulfate as the active agent when the concentration of additives in the form of organic sulfur compounds, inorganic sulfur compounds, organic sulfur-free nitrogen compounds, and inorganic sulfur-free nitrogen compounds are increased to increase the current yield, when the speed of the solution of less noble metals than copper is inhibited and when an organic complex former is added to the pickle.

7 Claims, 1 Drawing Sheet

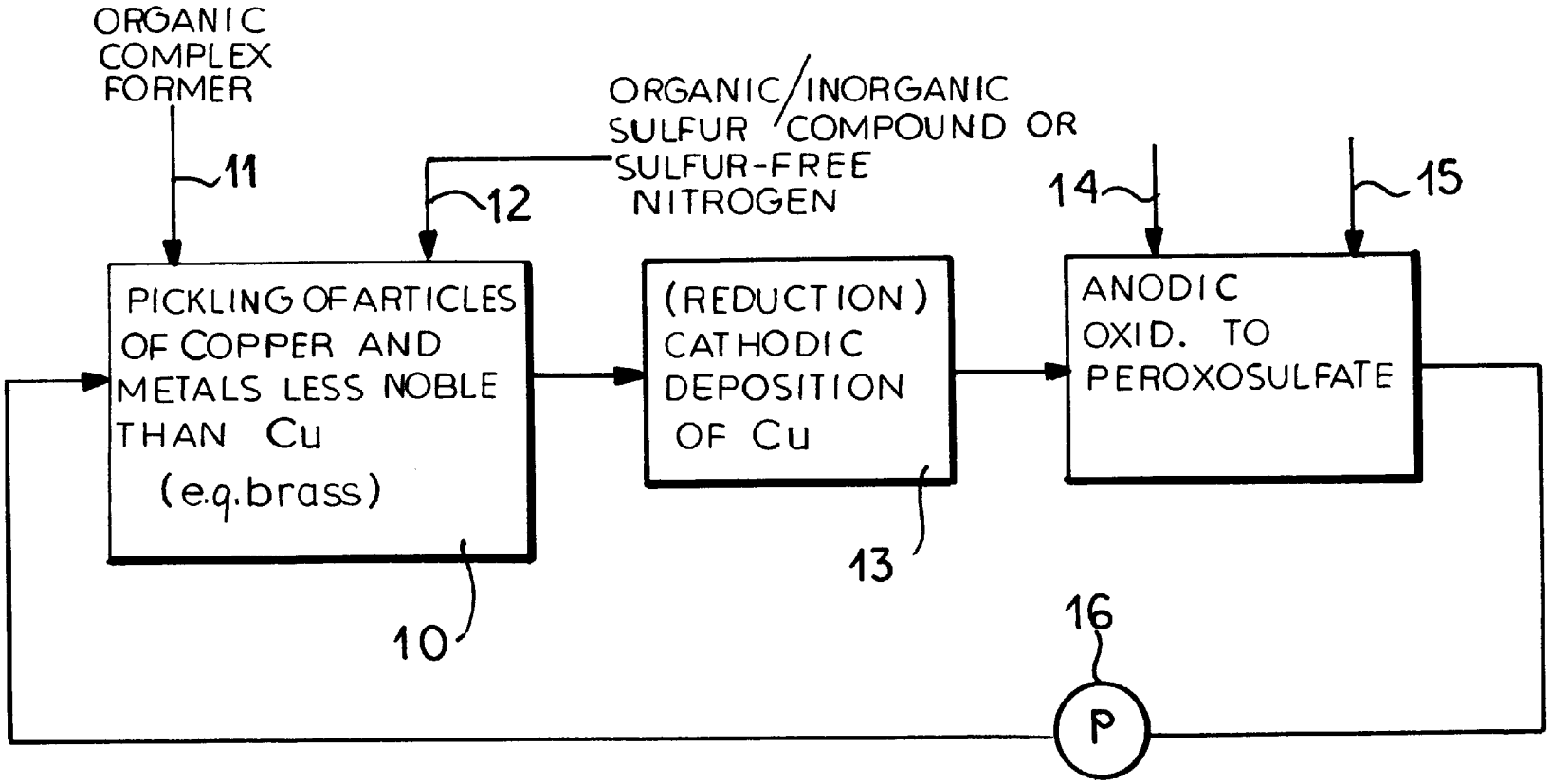
ORGANIC COMPLEX FORMER
11
PICKLING OF ARTICLES OF COPPER AND METALS LESS NOBLE THAN Cu (e.g. brass)
10
ORGANIC/INORGANIC SULFUR COMPOUND OR SULFUR-FREE NITROGEN
12
(REDUCTION) CATHODIC DEPOSITION OF Cu
13
14
ANODIC OXID. TO PEROXOSULFATE
15
16
P

METHOD OF PICKLING ARTICLES OF COPPER AND METALS LESS NOBLE THAN COPPER

FIELD OF THE INVENTION

Our present invention relates to a method of pickling articles of copper and metals less noble than copper, especially articles of copper and brass.

BACKGROUND OF THE INVENTION

In the pickling of copper-containing articles it is known to make use of an aqueous peroxosulfate-containing a pickling solution which, in regeneration, is subjected first to a cathodic reduction to deposit out copper that has been dissolved in the pickling solution in a cathodic deposition and then to anodic oxidation to reform the peroxosulfate from sulfate ions contained in the used pickling solution.

It is also known in this regenerating process to increase the current efficiency of the anodic peroxosulfate formation, to introduce additives which can be organic sulfur compounds, inorganic sulfur compounds, organic sulfur-free nitrogen compounds or inorganic sulfur-free nitrogen compounds.

The technique has been used for the pickling of copper as well as for the pickling of copper alloys, especially brass. Brass is an alloy of copper and zinc and zinc is in this case an example of a metal less noble than copper.

In the pickling of copper and brass with peroxodisulfate containing pickling solutions, where the pickling solution after use is subjected to regeneration in the manner described, initially involving a cathodic reduction in which most of the copper dissolved in the pickle is cathodically deposited out, some of the peroxosulfate which remains is invariably cathodically reduced. In the subsequent process step the peroxodisulfate is electrochemically regenerated by anodic oxidation of the sulfate ions usually on smooth platinum electrodes. To ensure a sufficiently high current yield for the anodic oxidation, the sulfate ion concentration in the solution must be relatively high. In prior systems, this can be achieved by adding to the pickling solution to be regenerated, a solution with a high concentration of alkali metal sulfate ions or ammonium sulfate ions. To increase the current yield (current efficiency) of the anodic peroxodisulfate formation, solutions of such additives which are so-called potentially-raising substances can be supplied. The usual additives for the purpose have included, for example, ammonium thiocyanate, sodium thiocyanate or thiourea. These additives are usually supplied in concentrations of $0.5\times10^{-3}$ mol/l to $5\times10^{-3}$ mol/l.

In such earlier processes, problems have been encountered when copper alloys e.g. brass, have been pickled and especially when the pickling is carried out of both articles composed of copper and articles composed of brass.

In pickling with solutions of the aforedescribed type, brass has a tendency to dissolve more rapidly in the pickling solution than does copper. In fact, one cannot obtain satisfactory results if, for example, a system designed for the pickling of copper articles is then used for the pickling of brass articles without modification, or for the pickling of both copper and brass articles. When such solutions are used to pickle brass articles, the composition of the pickling solution and/or the pickling duration or exposure time must be altered. Such modification is necessary if one wishes to have a satisfactory surface quality of the metal articles and prevent the so-called over-pickling of the brass.

When articles composed of both brass and copper are to be pickled, the problem becomes more acute since conditions at which copper is satisfactorily pickled can result in an overpickling of the brass with detriment to the surface quality. If, however, the conditions are designed for the pickling of brass, the copper surface can be insufficiently pickled so that again the surface quality may be detrimentally affected.

OBJECTS OF THE INVENTION

It is, therefore, the principal object of the present invention to provide a pickling method which can be used to obtain satisfactory quality surfaces for articles of copper and copper alloys with metals less noble than copper, especially copper and brass.

Another object of the invention is to provide a method of pickling such articles in which the same conditions can be used for the pickling of both articles of copper and articles of brass in terms of the composition of the pickling solution, the duration of the pickling operation or the exposure time, and the like.

Still another object of this invention is to provide a pickling method which overcomes drawbacks of prior art techniques.

SUMMARY OF THE INVENTION

These objects are attained, in accordance with the invention by providing an enhanced concentration of the additive promoting the anodic peroxosulfate formation, by inhibiting the velocity of dissolution of the less noble metal in addition to the current yield enhancement, and by adding at least one organic complex former to the pickling solution.

More particularly, the method of pickling articles of copper and articles of copper with a metal less noble than copper, especially copper and brass, can comprise the steps of:

(a) treating the articles with an aqueous peroxosulfate pickling solution, thereby forming a used pickling solution;

(b) cathodically reducing the used pickling solution with cathodic deposition of copper from the used pickling solution, thereby forming a reduced solution;

(c) adding to the reduced solution a relatively high concentration of at least one additive promoting anodic peroxosulfate formation and selected from the group which consists of organic sulfur compounds, inorganic sulfur compounds, organic sulfur-free nitrogen compounds, inorganic sulfur-free nitrogen compounds and mixtures thereof;

(d) anodically oxidizing the reduced solution to which the additive has been added to regenerate peroxosulfate from sulfate ion therein, thereby forming a regenerated pickling solution, and recycling the regenerated pickling solution to step (a);

(e) inhibiting a dissolution velocity of the metal less noble than copper during treatment of the articles in step (a); and (f) adding to the solution in step (a) at least one organic complex-forming substance.

In a preferred embodiment of the invention, a peroxodisulfate, preferably sodium peroxodisulfate, and/or a peroxomonosulfate, preferably sodium peroxomonosulfate, can be added to the pickling solution, The peroxosulfate additive is preferably supplied in an amount of 30 to 100 g/l, most preferably in an amount of 50 to 80 g/l.

Of course in order to ensure a high current yield during the anodic oxidation and for the anodic peroxosulfate formation, there must be a sufficiently high concentration of sulfate ions present. During the anodic oxidation, sulfate ion is oxidized especially to peroxodisulfate ions and alkali sulfate and/or ammonium sulfate can be added to the pickling solution to increase the sulfate ion concentration. The alkali sulfate and/or ammonium sulfate is added in an amount of 50 to 350 g/l; preferably an amount of 100 to 300 g/l.

It has also been found to be advantageous to add to the pickling solution zinc sulfate and/or copper sulfate and/or iron sulfate. The latter compound can be added alone or in combination with the above-mentioned alkali sulfates and/or ammonium sulfate.

The goals of the invention can be achieved by adjusting the sulfate ion content with the aid of zinc sulfate and/or copper sulfate and/or iron sulfate. Preferably the zinc sulfate and/or copper sulfate and/or iron sulfate is supplied in an amount of 20 to 250 g/l, more preferably in an amount of 50 to 200 g/l and most preferably in an amount of 100 to 200 g/l.

According to a preferred embodiment of the invention, in order to increase the current yield of the anodic peroxosulfate formation in the pickling solution to be recycled, an additive from the group of thiocyanates, thioureas, thiocarbaminates and thiosemicarbazides is supplied.

The thiocyanates are preferably ammonium thiocyanate and/or sodium thiocyanate.

It is also possible to utilize an additive from the group of cyanides, cyanates, cyanamides, hexamethylenetetramine and urotropin. The additive is preferably provided in an amount which is increased above the usual concentrations and advantageously at such concentrations as to inhibit the solubility of the less noble metal during pickling, i.e. in such concentrations as will reduce the dissolution velocity. The additive or additives can be provided in a total concentration of $10^{-2}$ to $5\times10^{-2}$ mol/l.

The additive is preferably fed to the pickling solution following the anodic oxidation or anodic peroxosulfate formation. However it is also within the scope of the invention to bring about the required concentration of the additive in the pickling solution during preparation of the pickling solution at the outset or by addition of the additive to the solution at some other point in the process.

The organic complex formers which can be used are preferably dicarboxylic acids, carboxylic acids with more than two carboxyl groups, hydroxycarboxylic acids, polyvalent alcohols, or amines with more than one hydroxy group.

Preferably the organic complex former is malic acid, citric acid, gluconic acid, succinic acid or ethylenediaminetetraacetic acid (EDTA). The organic complex former can also be triethanolamine, a polyvalent alcohol or a like glycerine. The complex former is most advantageously added after anodic oxidation or anodic regeneration of the peroxosulfate. The complex former can be provided in the original composition of the pickle solution and the concentration thereof can be restored continuously in regeneration of the pickle. The concentration of the complex former should be in the order of $10^{-2}$ mol/l and preferably the organic complex former is added in an amount of 0.5 to 2 g/l, preferably 1 to 1.5 g/l.

The pickling operation yields articles of copper and alloys of copper with less noble metal which have uniformly satisfactory surface qualities. Articles of copper and brass can be simultaneously pickled with the same pickling solution and under the same conditions without poor surface results for one of the metals. The same pickle solution can be used for alternately pickling copper and brass, also the same pickling conditions without drawbacks. The same pickling conditions mean here the same composition of the pickling solution and same pickling duration or exposure time.

The invention does utilize similar compounds to increase the current yield and has inhibitors for the dissolution of the less noble metal from brass, for example, as have been used previously but in increased concentrations. When such so-called potentially raising compounds are used, the dissolution speed of the less noble metal of, for example, brass approximates the dissolution speed of the copper. The result is high surface qualities for articles of both metal components, an improvement which is further enhanced by the organic complex formers which are added. These complex formers appear to prevent discoloration of the metal surfaces or the formation of surface patterns thereon.

The compounds serving as inhibitors in the pickling step, in spite of their presence at higher concentrations than in the art, do not interfere with the ability to operate at high current yields in the anodic peroxosulfate formation. Indeed, it is surprising that a concentration increase in these additives does not entail any drawbacks in the anodic oxidation. A portion of the additive may be decomposed during the pickling process by the oxidizing effect of the peroxosulfate. Even the organic complex former may be partly oxidized during the pickling process. That has not been found, however, to be detrimental to the anodic oxidation and do not have an adverse effect on the current yield of the anodic peroxosulfate formation. The invention thus provides an inexpensive and simple way of achieving the aforementioned objects.

It is not essential, in the present invention that a peroxosulfate be added to the pickling solution. It is possible within the framework of the invention to utilize only sulfates or sulfate ions in the pickling solution and to form the peroxosulfate by anodic oxidation, especially to the peroxodisulfate.

Basically the process can be carried out in an apparatus having a pickling vessel and means for regenerating the pickling solution in a separate receptacle for cathodic reduction with copper deposition. Then the depleted pickling solution is subjected to anodic oxidation to regenerate the peroxosulfate in a further vessel before being recycled to the pickling vessel. However, it is also possible to carry out the cathodic reduction and copper deposition directly at the cathode or in the cathode compartment of the electrolysis cell used for peroxosulfate regeneration. In that case the cathodic copper deposition is carried out simultaneously with the anodic oxidation or peroxodisulfate regeneration. The anodic oxidation is preferably carried out on smooth platinum electrodes.

BRIEF DESCRIPTION OF THE DRAWING

The above and other objects, features, and advantages will become more readily apparent from the following description, reference being made to the sole Figure which is a flow diagram showing an apparatus for carrying out the invention.

SPECIFIC DESCRIPTION AND EXAMPLES

The sole Figure of the drawing shows a pickling vessel 10 in which articles of copper and/or brass can be pickled with addition of the complex former at 11 and the organic or inorganic sulfur compound or organic or inorganic sulfur-free nitrogen compound as has been described at 12. The pickle is then subjected at 13 to reduction and cathodic deposition of copper, preferably on a smooth platinum cathode, whereupon the pickle is subjected to anodic oxidation to reform the peroxosulfate. The additive can be supplied at 14 to the regenerating solution and at 15, a sulfate can be supplied. The regenerated solution is recycled by the pump 16 to the pickling vessel.

The following examples are illustrations of compositions of the aqueous pickling solution which can be used, the pickling being carried out for conventional pickling times at room temperature of copper or brass articles.

EXAMPLE 1

200 g/l sodium sulfate, 100 g/l zinc sulfate, 50 g/l sodium peroxodisulfate, 0.2 g/l thiourea, 1 g/l ethylenediaminetetraacetic acid (EDTA). The EDTA is decomposed on anodic oxidation and has to be replenished directly in the pickling vessel.

EXAMPLE 2

100 g/l sodium sulfate, 150 g/l zinc sulfate, 50 g/l copper sulfate, 0.2 g/l sodium thiosulfate, 1 g/l gluconic acid. This solution is subjected to anodic oxidation prior to introduction into the pickling vessel.

EXAMPLE 3

300 g/l sodium sulfate, 70 g/l sodium peroxodisulfate, 10 g/l sodium peroxomonosulfate, 0.3 g/l sodium thiosulfate, 0.1 g/l malic acid, 0.1 g/l acetic acid.

EXAMPLE 4

150 g/l sodium sulfate, 100 g/l zinc sulfate, 50 g/l copper sulfate, 70 g/l sodium peroxomonosulfate, 0.5 g/l thiourea, 0.5 g/l succinic acid, 0.5 g/l gluconic acid.

EXAMPLE 5

100 g/l sodium sulfate, 100 g/l zinc sulfate, 50 g/l copper sulfate, 50 g/l sodium peroxodisulfate, 0.3 g/l thiourea, 0.5 g/l succinic acid, 1 g/l triethanolamine.

Of course all of the solutions above may have the peroxosulfate levels enhanced by anodic oxidation before use in the pickling vessel.

We claim:

1. A method of pickling articles of copper or articles of copper with a metal less noble than copper, comprising the steps of:

(a) treating said articles with an aqueous peroxosulfate pickling solution, thereby forming a used pickling solution, depleted in peroxosulfate, and containing dissolved copper or dissolved copper and metals less noble than copper, said used pickling solution further comprising:

(1) at least one compound selected from the group which consists of alkali sulfates and ammonium sulfate and mixtures thereof in an amount of 50 to 350 g/l and;

(2) at least one compound selected from the group which consists of zinc sulfate, copper sulfate and iron sulfate and mixtures thereof in an amount of 20 to 250 g/l;

(b) cathodically reducing said used pickling solution with cathodic deposition of copper from said used pickling solution, thereby forming a reduced solution;

(c) adding to said reduced solution a relatively high concentration of at least one additive promoting anodic peroxosulfate formation and selected from the group which consists of organic sulfur compounds, inorganic sulfur compounds, organic sulfur-free nitrogen compounds, inorganic sulfur-free nitrogen compounds and mixtures thereof;

(d) anodically oxidizing said reduced solution to which said additive has been added to regenerate peroxosulfate from sulfate ion therein, thereby forming a regenerated peroxosulfate pickling solution, and recycling said regenerated pickling solution to step (a);

(e) inhibiting a dissolution velocity of said metal less noble than copper during treatment of said articles in step (a) by adding to said pickling solution a compound selected from the group consisting of cyanides, cyanates, cyanamides, hexamethylenetetramine and urotropin in a concentration of $10^{-2}$ to $5\times10^{-2}$ mol/l.; and (f) adding to the solution in step (a) at least one organic complex-forming substance.

2. The method defined in claim 1 wherein at least one compound selected from the group which consists of peroxodisulfates and peroxomonosufates is added to said solution in step (a).

3. The method defined in claim 2 wherein said at least one compound is sodium peroxodisulfate or sodium peroxomonosulfate.

4. The method defined in claim 1 wherein according to step (a) said at least one compound is added to said solution in step (a) in an amount of 100 to 300 g/l.

5. The method defined in claim 1 wherein at least one additive promoting anodic peroxosulfate formation selected from the group which consists of thiocyanate, thiourea, thiocarbaminates and thiosemicarbazides is added to said solution in step (c).

6. The method defined in claim 1 wherein said organic complex-forming substance is selected from the group which consists of dicarboxylic acids, carboxylic acids having more than two carboxyl groups, hydroxycarboxylic acids, polyvalent alcohols and amines having more than one hydroxy group.

7. The method defined in claim 6 wherein said organic complex-forming substance is selected from the group which consists of malic acid, citric acid, gluconic acid, succinic acid and ethylenediaminetetraacetic acid.

* * * * *